United States Patent [19]

Riordan

[11] 4,329,138

[45] May 11, 1982

[54] PROVING SYSTEM FOR FUEL BURNER BLOWER

[75] Inventor: William J. Riordan, Shrewsbury, Mass.

[73] Assignee: Walter Kidde and Company, Inc., Clifton, N.J.

[21] Appl. No.: 158,899

[22] Filed: Jun. 12, 1980

[51] Int. Cl.[3] ..... F23H 1/02

[52] U.S. Cl. ..... 431/90

[58] Field of Search ..... 431/90, 72, 12; 126/116 A

[56] References Cited

U.S. PATENT DOCUMENTS

| | | | |
|---|---|---|---|
| 3,357,473 | 12/1967 | Blackett et al. | 431/90 X |
| 3,592,574 | 7/1971 | Zenkner | 431/90 |
| 3,825,397 | 7/1974 | Johansson et al. | 431/90 X |
| 3,969,064 | 7/1976 | Ballentine | 431/90 |

*Primary Examiner*—Samuel Scott
*Assistant Examiner*—Randall L. Green
*Attorney, Agent, or Firm*—John E. Toupal

[57] ABSTRACT

The invention is a fuel burner system including an electrical control circuit for initiating fuel flow to a burner in response to a call-for-heat from a condition responsive sensor, and an electrical ignitor for igniting the fuel emanating from the burner. Combustion or purging air is directed to the burner by a fan, the integrity of which is monitored by a sensor circuit that produces a fault signal in response to rotation of the fan at any speed in a given range of speeds. An inhibit circuit inhibits the control circuit to prevent opening of a fuel supply valve in response to the presence of the fault signal. Fan rotation at speeds either above or below a predetermined normal range indicates a malfunction and results in the fault signal that prevents the initiation of fuel flow and a try for ignition.

22 Claims, 5 Drawing Figures

PROVING SYSTEM FOR FUEL BURNER BLOWER

BACKGROUND OF THE INVENTION

This invention relates to a blower proving system for a fuel burner and, more specifically, to such a system utilizing a fan rotational speed sensor.

For many fuel burner installations, it is desirable to provide a purge period prior to the initiation of fuel flow and the occurrence of ignition at a burner. During the purge period, a blower is energized to dissipate any fuel vapor that may have accumulated in the combustion chamber because of some inadvertence, such as a leaky fuel valve. The dissipation of such residual fuel vapor reduces the possibility of an explosion during an attempt to ignite newly released fuel. However, the safety provided by a purge period can be comprised by a malfunctioning blower system that fails to adequately dissipate residual fuel vapor in the vicinity of the vapor. Such a malfunction can result from either a mechanical failure of the blower itself or some type of obstruction that prevents the blower from forcing air through a purge zone occupied by the burner. To eliminate the danger associated with defective blower systems, some fuel burner arrangements employ air-proving devices that monitor the presence of purging air near the burner prior to an attempt at ignition. Generally, the air-proving devices use detectors that sense either air flow or air pressure in the vicinity of the burner. The most common type of detector is a pivotally mounted flat plate that is moved by air velocity to operate a microswitch. Closing the microswitch establishes a ready signal that is required for ignition. Such detectors are commonly referred to as sail switches. A serious deficiency of sail switches is their tendency to stick in the "on" position resulting in the presence of a ready signal in even those instances in which a blower system has malfunctioned. Furthermore, no provision exists for indicating such a stuck switch condition.

The object of this invention, therefore, is to provide a system used to provide purging air to fuel burner installations.

SUMMARY OF THE INVENTION

The invention is a fuel burner system including an electrical control circuit for initiating fuel flow to a burner in response to a call-for-heat from a condition responsive sensor and an electrical ignitor for igniting the fuel emanating from the burner. Combustion or purging air is directed to the burner by a fan, the integrity of which is monitored by a sensor circuit that produces a fault signal in response to rotation of the fan at any speed in a given range of speeds. An inhibit circuit inhibits the control circuit to prevent opening of a fuel supply valve in response to the presence of the fault signal. Fan rotation at a speed in a given abnormal range of speeds indicates a malfunction and results in the fault signal that prevents the initiation of fuel flow and a try for ignition.

In preferred embodiments of the invention, the sensor circuit includes a pulse generating detector that produces a pulse in response to the movement of fan blades through a predetermined detection zone. In one embodiment, the pulse generating detector comprises an electrical generator that provides, in the detection zone, a magnetic field that is disturbed by the moving fan blades. In another embodiment, the pulse generating detector comprises a source that directs a beam of radiant energy into the detection zone and a radiant energy detector that produces an electrical output in response to changes in the level of radiant energy received from the detection zone.

According to one feature of the invention, the control circuit initiates fan operation in response to a call-for-heat signal from the condition responsive sensor and thereafter establishes a substantial purge period prior to opening of the fuel supply valve. This control feature establishes fan operation only when needed and insures that the burner region will be cleared of combustible fuel mixtures prior to the initiation of the desired fuel flow and a try for ignition. Preferably, the sensor circuit produces a fault signal in response to fan rotation at speeds in either a first range below a normal operating range or a second range above the normal range. Fan operation in the first range is indicative of an underspeed condition that can result from a mechanical failure of some kind. Fan operation in the second range is indicative of an overspeed condition that can result, for example, from the presence of an air duct obstruction that appears to the fan as a loss of load. Either the underspeed or the overspeed condition is abnormal and generates a fault signal that prevents opening of the fuel supply valve.

DESCRIPTION OF THE DRAWINGS

These and other features and objects of the present invention will become more apparent upon a perusal of the following description taken in conjunction with the accompanying drawings wherein.

DESCRIPTION OF THE PREFERRED EMBODIMENT

Figure 1:
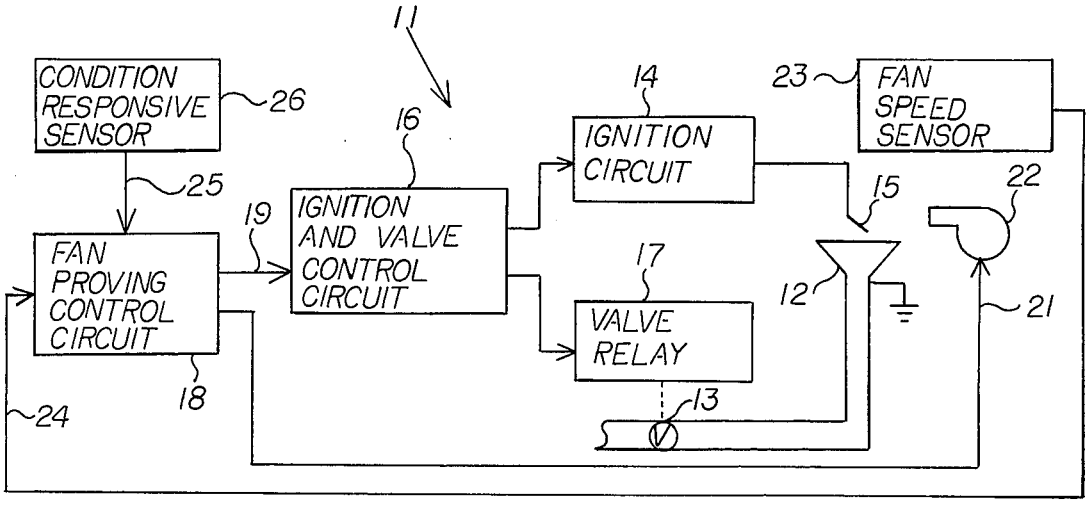
FIG. 1 is a schematic block diagram of the invention.

Illustrated in FIG. 1 is a fuel burner system 11 including a burner 12 that receives fuel through a control valve 13. Fuel emanating from the burner 12 is ignited by sparks generated with an ignition circuit 14 and passing between an electrode 15 and the grounded burner 12. An ignition and valve control circuit 16 controls the ignition circuit 14 and energizes a valve relay 17 that opens the fuel supply valve 13. Activating of the ignition and valve control circuit 16 is a fan-proving control circuit 18 that provides a start-up signal on a line 19. The control circuit 18 also provides on a line 21 power to energize a blower fan 22 that forces air to the burner 12. A fan speed sensor 23 monitors the rotational speed of the fan 22 and produces on a line 24 a fan speed signal that is received by the fan-proving control circuit 18. Also received by the fan-proving control circuit 18 on a line 25 are call-for-heat signals produced by a condition responsive sensor 26 such as a thermostat.

In response to a call-for-heat signal on the line 25, the fan-proving control circuit 18 energizes the fan 22 producing a flow of air that purges any residual fuel vapor present at the burner 12. Subsequently, after a substantial purge period of, for example, 20 seconds, the fan-proving control circuit 18 responds to the speed signal on line 24 by either providing or failing to provide a start-up signal on the line 19. As described in greater detail below, the fan speed sensor 23 produces on the line 24, a speed signal having a pulse rate dependent on the rotational speed of the fan 22. A speed signal indicating rotation of the fan 22 within a normal range of speeds causes the control circuit 18 to produce a start-up signal that activates the ignition and valve control circuit 16. After actuation, the valve ignition and valve control circuit 16 energizes the relay 17 to open the valve 13 and initiate fuel flow to the burner 12. Simultaneously, the control circuit 16 energizes the ignition circuit 14 to establish between the electrode 15 and the burner 12 sparks that ignite fuel emanating therefrom. This operation of the valve and ignition control circuit 16, the ignition circuit 14, and the valve relay 17 are conventional and of the type, for example, that is described in detail in U.S. Pat. No. 3,853,455.

Conversely, in response to a signal on the line 24 indicating a fan speed in a given range outside its normal operating range, the fan proving control circuit 18 fails to produce a start-up signal on the line 19. In the absence of a start-up signal, the ignition circuit 14 is not activated and the valve 13 remains closed to prevent fuel flow to the burner 12. As described below, an abnormal speed can consist of either a low speed condition typically caused by a mechanical failure of the fan 22 or a high speed condition typically produced by the existence of an obstruction that prevents air from reaching the burner 12.

Figure 2:
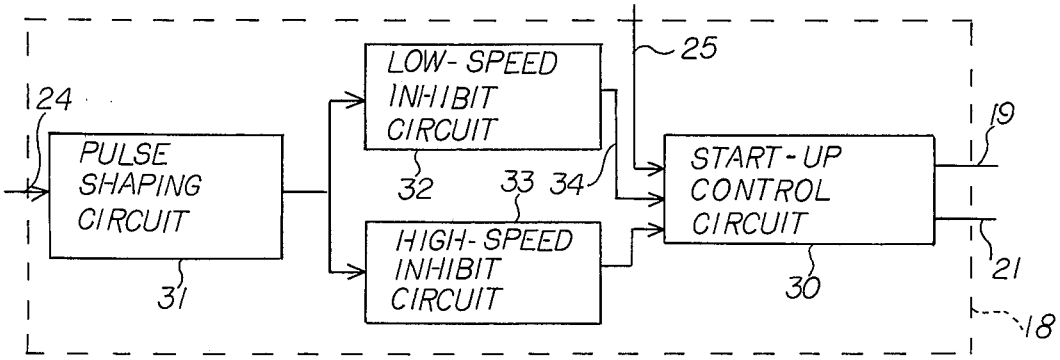
FIG. 2 is a schematic block diagram of the fan-proving control circuit shown in FIG. 1.

FIG. 2 illustrates in block diagram form further details of the fan proving circuit 18 shown in FIG. 1. A call-for-heat signal on the line 25 causes a start-up control circuit 30 to energize the blower fan 22 (FIG. 1) via the line 21. The resultant speed indicating signal received on line 24 from the fan speed sensor 23 (FIG. 1) is shaped in a pulse-shaping circuit 31 and fed to both a low speed inhibit circuit 32 and a high speed inhibit circuit 33. In response to a speed signal indicating fan rotation at any speed less than the minimum of a predetermined normal operating range, the low speed inhibit circuit produces a fault signal on line 34. Similarly, in response to a speed signal indicating fan rotation at any speed greater than the maximum of the predetermined normal operating range, the high speed inhibit circuit 33 produces a fault signal on line 35. The presence of a fault signal on either line 34 or 35 inhibits the start-up control circuit 30 that consequently fails to produce a start-up signal on the line 19. Conversely, with the fan operating within a predetermined normal range, the circuits 32 and 33 fail to produce fault signals that inhibit the start-up control circuit 30 which accordingly produces on line 19 a start-up signal that initiates burner operation.

Figure 3:
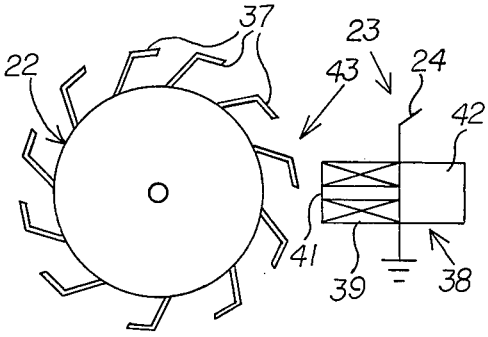
FIG. 3 is a schematic view of one fan speed sensor embodiment of the invention.

FIG. 3 schematically illustrates one embodiment of a fan speed sensor 23 for monitoring the rotational speed of the fan 22 that possesses a plurality of spaced apart steel fan blades 37.

The sensor 23 is an electrical generator 38 including an electrical coil 39 wound on an iron core 41. Producing a magnetic field in the core 41 is a permanent magnet 42. One end of the coil 39 is grounded while the opposite end is connected to the signal line 24. During rotation of the fan 22, the fan blades 37 pass through a detection zone 43 permeated by the magnetic field of the generator 38. As each blade 37 passes through the detection zone 43, the magnetic field is disturbed producing a signal pulse on the line 24. Thus, the output of the generator 38 on the line signal line 24 is an ac current with a frequency proportional to the rotational speed of the fan 22.

Figure 4:
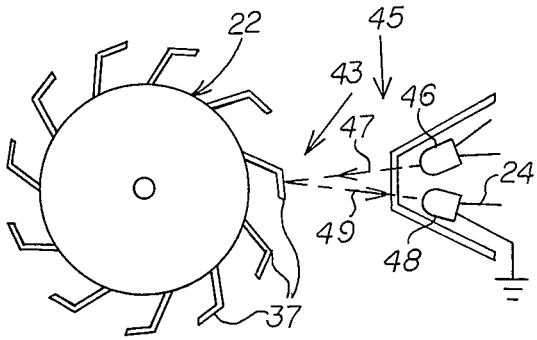
FIG. 4 is a schematic view of another fan speed sensor embodiment of the invention.

FIG. 4 schematically illustrates another fan speed sensor embodiment 45 for use with the system of FIG. 1. The sensor 45 includes a light source 46 that directs a beam of light energy 47 into the detection zone 43 and a phototransistor 48 that receives light energy 49 reflected therefrom. As each blade 37 passes through the detection zone 43, a portion of the light beam 47 is reflected to the phototransistor 48. These changes in the level of radiation received by the phototransistor 48 results in the appearance of signal pulses on the line 24. Again, therefore, the resultant signal on the line 24 is an ac current proportional to the rotational speed of the fan 22.

Figure 5:
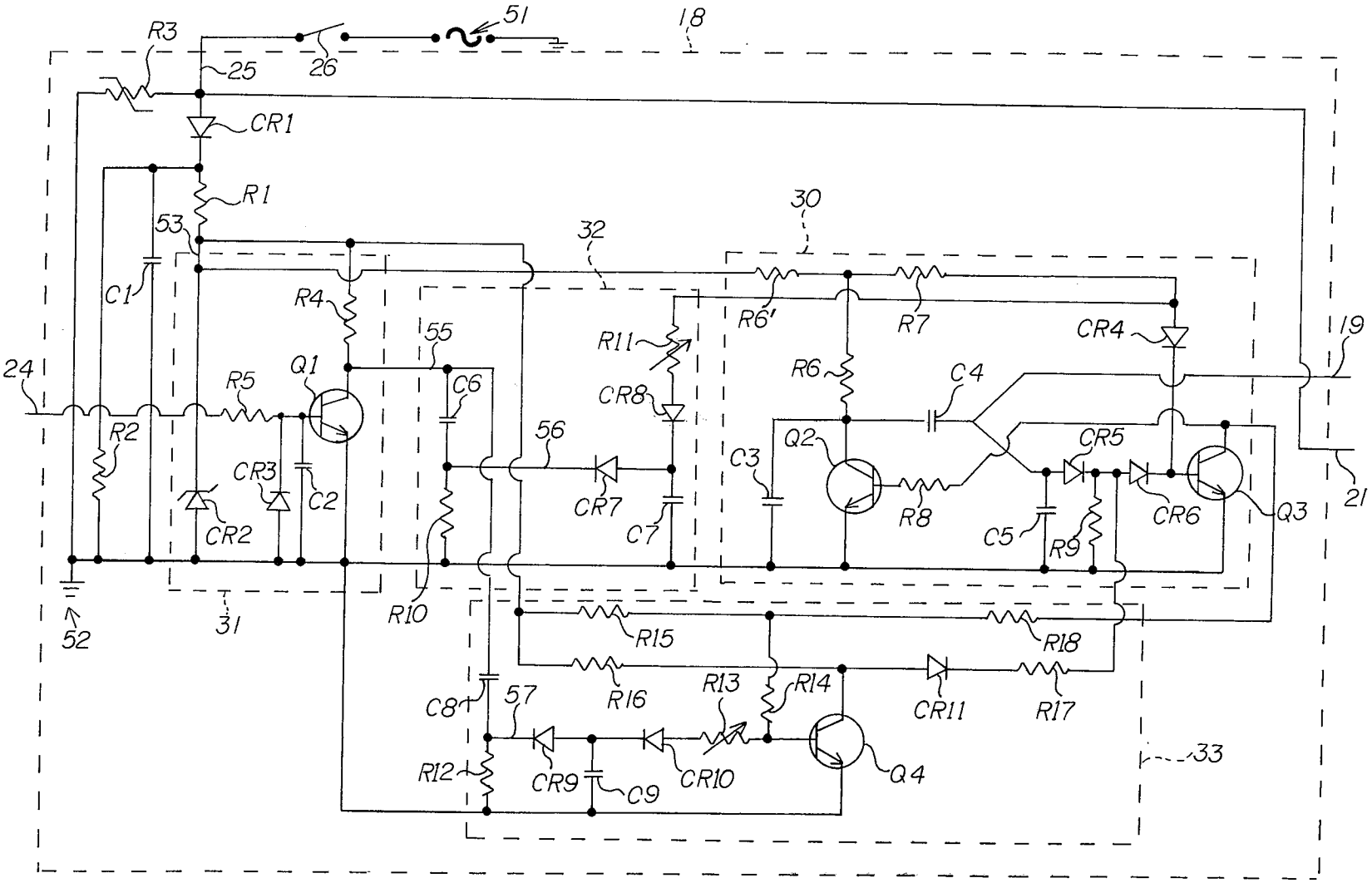
FIG. 5 is a schematic circuit diagram of the fan-proving control circuit shown in FIG. 1.

Referring now to FIG. 5, there are depicted circuit details of the fan proving control circuit 18 shown in FIG. 2. An ac supply 51 is connected to ground 52 by the condition responsive thermostat 26, a diode CR1, a resistor R1, and a voltage regulating zener diode CR2. Filtering is provided by a capacitor C1 and a resistor R2. Also connected between the supply 51 and ground 52 is a varistor R3 that clips line transients. The diode CR2 establishes a stable voltage supply 53 that is connected by a resistor R4 to the collector of a transistor Q1, the emitter of which is connected to ground. Connected to the base of the transistor Q1 by a resistor R5 is the input signal on line 24 from the fan speed sensor 23 (FIG. 1). A diode CR3 and a capacitor C2 are connected between ground and the base of the transistor Q1.

The supply 53 also is connected to the start-up control circuit 30 which includes a basic multi-vibrator consisting of a pair of transistors Q2 and Q3 and associated resistors R6–R9, capacitors C3–C5, and diodes CR4–CR6. The output of the wave shaping circuit 31 on a line 55 is applied to a differentiator C6, R10 in the low speed inhibit circuit 32. Receiving the output of the differentiator C6, R10 on a line 56 via a diode CR7, is a first storage capacitor C7. The junction between the storage capacitor C7 and the diode CR7 is connected by a diode CR8 and an adjustable resistor R11 to the junction between the resistor R7 and the diode CR4 in the start-up control circuit 30. Also receiving the signal output on line 55 in the high speed inhibit circuit 33 is a differentiator C8, R12 that provides an output on a line 57 via a diode CR9 to a second storage capacitor C9. The voltage on the second storage capacitor C9 is applied by a diode CR10 and an adjustable resistor R13 to the base of a transistor Q4 which is also connected by resistors R14 and R15 to the supply 53. The collector of the transistor Q4 is connected by a resistor R16 to the supply 53 and by a diode CR11, a resistor R17 and the diode CR6 to the base of the transistor Q3 in the start-up control circuit 30. Connecting the collector of the transistor Q3 to the base of the transistor Q4 is a resistor R18 and the resistor R14.

During normal operation, the closure of the thermostat 26 results in the energization of the fan 22 and the application of power to the start-up control circuit 30. After power is applied, the transistor Q3 is turned on as base current is supplied by the resistor R7 and the charging current to the capacitor C4. At this time the transistor Q2 is off as no base current can flow thereto with the transistor Q3 on. This condition persists for a substantial purge period of, for example, 20 seconds which allows the fan 22 to reach normal speed and purge the region around the burner 12 (FIG. 1) of residual fuel vapor. Assuming that the fan 22 reaches normal operating speed, base current flow to the transistor Q3 through the resistor R7 is diverted by the low speed inhibit circuit 32 as described below. Thus, after full charging of the capacitor C4 to eliminate base current, the transistor Q3 turns off and as its collector voltage comes up, current is diverted through a resistor R8 to the base of the transistor Q2. With the transistor Q2 now on, the plus side of the capacitor C4 is tied to ground and the capacitor C4 produces on line 19 a start-up signal that activates the ignition and valve control circuit 16 (FIG. 1) in the manner described in the above noted U.S. Pat. No. 3,853,455. That in turn results in opening of the fuel supply valve 13 and energization of the ignition circuit 14.

The speed indicating signal produced by the fan speed sensor 23 on line 24 is applied to the base emitter of the transistor Q1. Noise pickup is minimized by the R5, C2 filter while the diode CR3 protects the base emitter junction from reverse voltage. Biased at cutoff as a basic amplifier, the transistor Q1 is switched from cutoff to saturation by the alternating speed signal on line 24 producing a square wave at the collector output 55. That output is applied to the differentiator C6, R10 which responds to the leading and trailing edges by producing positive and negative pulses on line 56. These pulses are of uniform height and duration and thereby provide a consistent charge mechanism for a capacitor C7 regardless of the original frequency or wave form distortion of the speed signal on line 24. The negative pulses on the line 56 pass through the diode CR7 and charge the storage capacitor C7 to the polarity indicated. With a resistive load on the capacitor C7, the charging voltage varies in relation to the number of pulses received and is therefore proportional to the fan speed detected by the fan speed sensor 23. Assuming that the fan 22 is operating in a normal speed range, the capacitor C7 is charged sufficiently negative to divert current from the resistor R7 and back bias the diode CR4. This allows the transistor Q3 to turn off after full charging of the capacitor C4 as described above. Thus, operation of the fan 22 at normal speeds results in initiation of gas flow to the burner 12 and energization of the ignition circuit 14.

Assume next, however, that an electrical or mechanical malfunction limits the rotational speed of the fan 22 to a given range between zero and the minimum value of a predetermined normal operating range. In that case the frequency of pulses on the line 56 is reduced and the resultant fault indicating negative charge on the capacitor C7 is insufficient to sink current from the resistor R7. Consequently, the transistor Q3 remains on to hold the transistor Q2 off and prevent the appearance of a start-up signal on the signal line 19. As a result of the detected fan operational deficiency and the absence of a start-up signal, energization of the ignition circuit 14 and opening of the valve 13 are desirably prevented. It will be noted that the charge established on the capacitor C7 is of a polarity opposite to that on the supply line 53. Thus, inadvertent circuit failures in the low speed inhibit circuit 32 cannot produce a condition that will sink the resistor R7, permit turnoff of the transistor Q3, and generate a start-up signal on the line 19.

An overspeed condition of the fan 22 is detected by the high speed inhibit circuit 33. The square wave output of the shaping circuit 31 on line 55 is applied to the differentiator C8, R12 resulting in pulses on line 57 that charge second storage capacitor C9. Assuming that the fan 22 is operating in a given speed range above the maximum of the predetermined normal operating range, the charge on the capacitor C9 becomes sufficiently negative to indicate a fault and turn off the transistor Q4. Its collector current is then available to maintain the transistor Q3 on even after full charging of the capacitor C4 and sinking of the resistor R7 by the capacitor C7. Accordingly, an overspeed condition also prevents the initiation of gas flow and the energization of the ignition circuit 14.

Thus, the invention renders operation of the burner 12 dependent on the rotational speed of the blower 22. Both the initiation of fuel flow through the valve 13 and energization of this ignition circuit 14 are prevented by rotation of the blower 22 at speeds either above or below a predetermined normal operating range required for safety. The predetermined normal range can be established or modified by adjustment of the variable resistors R11 and R13.

Obviously, many modifications and variations of the present invention are possible in light of the above teachings. It is therefore to be understood that within the scope of the appended claims, the invention can be practised otherwise than as specifically described.

What is claimed is:

1. A fuel burner ignition system comprising:

electrical igniter means for igniting fuel emanating from a burner;

a valve controlling the flow of fuel to the burner;

condition responsive means;

electrical start-up control circuit for opening said valve and energizing said igniter means in response to a call-for-heat signal from said condition responsive means;

a fan means for forcing air by the burner;

a sensor circuit for monitoring rotation of said fan and producing a speed signal indicative of the rotational speed thereof; and inhibit circuit means that produces a fault signal that prevents energization of said igniter means and opening of said valve in response to a value of said speed signal indicating any rotational speed of said fan means outside of a given range of speeds.

2. A system according to claim 1 wherein said fan means comprises a plurality of spaced apart blades, and said sensor circuit comprises detector means for detecting movement of said blades.

3. A system according to claim 2 wherein said detector means comprises pulse generating means producing pulses in response to movement of said blades through a detection zone.

4. A system according to claim 3 wherein said pulse generating means produces a pulse in response to movement of each said blade through said detection zone.

5. A system according to claim 4 wherein said pulse generating means comprises electrical generator means providing in said zone a magnetic field that is disturbed by passage of said blades therethrough.

6. A system according to claim 4 wherein said pulse generating means comprises a source directing a beam of radiant energy into said zone and a radiant energy detector producing an electrical output in response to changes in the level of radiant energy received from said zone.

7. A system according to claim 1 wherein said control circuit comprises fan control means for energizing said fan means in response to said call-for-heat signal.

8. A system according to claim 7 wherein said control circuit further comprises delay circuit means for delaying said opening of said valve for a substantial purge period after energization of said fan.

9. A system according to claim 1 wherein said range of speeds comprises any speed less than a given minimum speed.

10. A system according to claim 9 wherein said fan means comprises a plurality of spaced apart blades, and said sensor circuit comprises pulse-generating detector means for producing pulses in response to movement of said blades through a detection zone.

11. A system according to claim 10 wherein said inhibit circuit means comprises a capacitor charged to a voltage level proportional to the frequency of said pulses, and said fault signal is produced in response to a voltage level on said capacitor of less than a given threshold value.

12. A system according to claim 11 wherein said inhibit circuit means further comprises a power supply of a given polarity, and said threshold value is of a polarity opposite to said given polarity.

13. A system according to claim 12 wherein said inhibit circuit means further comprises a differentiator circuit connected to receive said pulses and to provide charging pulses to said capacitor.

14. A system according to claim 1 wherein said range of speeds comprises any speed greater than a given maximum speed.

15. A system according to claim 14 wherein said fan means comprises a plurality of spaced apart blades, and said sensor circuit comprises pulse-generating detector means for producing pulses in response to movement of said blades through a detection zone.

16. A system according to claim 15 wherein said inhibit circuit means further comprises a capacitor charged to a voltage level proportional to the frequency of said pulses, and said fault signal is produced in response to a voltage level on said capacitor of greater than a given threshold value.

17. A system according to claim 16 wherein said inhibit circuit means further comprises a differentiator circuit connected to receive said pulses and to provide charging pulses to said capacitor.

18. A system according to claim 1 wherein said range of speeds comprises any speed less than a given minimum speed and any speed greater than a given maximum speed.

19. A system according to claim 18 wherein said fan means comprises a plurality of spaced apart blades, and said sensor circuit comprises pulse-generating detector means for producing pulses in response to movement of said blades through a detection zone.

20. A system according to claim 19 wherein said inhibit circuit means further comprises first and second capacitors charged to voltage levels proportional to the frequency of said pulses, and said fault signal is produced in response to either a voltage level on said first capacitor of less than a given minimum threshold value or a voltage level on said second capacitor of greater than a given maximum threshold value.

21. A system according to claim 20 wherein said inhibit circuit means further comprises a power supply of a given polarity, and said minimum threshold value is of a polarity opposite to said given polarity.

22. A system according to claim 21 wherein said inhibit circuit means further comprises a differentiator circuit connected to receive said pulses and to provide charging pulses to said capacitor.

* * * * *